United States Patent [19]

Hallings

[11] Patent Number: 4,904,189

[45] Date of Patent: Feb. 27, 1990

[54] ROTATING CONTACT ASSEMBLY FOR ELECTRICAL SUPPLY

[75] Inventor: Leonard L. Hallings, Rochester, N.Y.

[73] Assignee: MDT Corporation, Rochester, N.Y.

[21] Appl. No.: 318,758

[22] Filed: Mar. 3, 1989

[51] Int. Cl.[4] ..... H01R 39/64

[52] U.S. Cl. ..... 439/13; 439/22

[58] Field of Search ..... 439/13, 18, 20–22, 439/27, 29

[56] References Cited

U.S. PATENT DOCUMENTS 4,049,351 9/1977 Suga ..... 439/13 X 4,175,809 11/1979 Dusko ..... 439/22

*Primary Examiner*—Eugene F. Desmond

*Attorney, Agent, or Firm*—Trask, Britt & Rossa

[57] ABSTRACT

An electrical contact assembly is structured within a mechanical pivot connection between a hollow post and a transverse hollow arm. Contact rings concentric with the post interact with brush contacts mounted within the arm.

17 Claims, 3 Drawing Sheets

ROTATING CONTACT ASSEMBLY FOR ELECTRICAL SUPPLY

BACKGROUND OF THE INVENTION

1. Field

This invention pertains to current delivery systems. It is directed to mechanisms which deliver current across a pivot connection, and provides an improved such mechanism whereby current is transferred from a source through an arm and post rotatable without limits.

2. State of the Art

It is often necessary or desirable to power implements or devices mounted by means of posts and arms. Such mechanical arrangements ideally permit positional manipulation of a powered device while avoiding the interference of external wiring, such as power cords. For this reason, power conductors are often incorporated within the hollow interiors of the structural arms and posts. Internal conductors restrict the manipulative capabilities of an arm mounted on a pivot connection to a post. Stops or limits are required to prevent repeated rotations of the arm. Yet, continuous, unrestricted rotation of an arm on a post or a post within an arm is highly desirable for a number of practical applications in such fields as robotics, manufacturing assembly, surgical lighting and machine tool operations.

There remains a need for an electrical contact assembly capable of transferring current from a source through a swivel or pivot connection whereby a transverse arm is permitted free and continuous rotation with respect to a fixed or rotatable post.

SUMMARY OF THE INVENTION

The present invention provides an electrical contact assembly which can be applied in a variety of mechanical contexts to deliver power through an arm such that the arm may be continuously rotated around a fixed post without stops or limits. The assembly may also be installed to permit the same degree of limitless rotation of a post mounted within either a fixed or movable arm.

Although the assembly may be embodied in various specific configurations, the presently preferred constructions include a core mounted inside a hollow post member. The post is conventionally cylindrical, at least in the vicinity of the assembly with an approximately circular cross section. The core may be constructed of electrical insulation materials, or it may be otherwise fashioned to provide electrical isolation of conduction components mounted in association with the core.

The core supports and houses conductive elements which are of sufficient mass to carry the current loads required for the application at hand. It is often conventional for the conductive elements to be configurated as bars which provide a means for mechanical securement as well as an electrical current path. The core may also function as an anchor for other components.

The number and arrangement of conductive elements associated with a core depends upon the application intended. Generally, one element is required for each power conductor required for the transfer of current across the assembly. A North American 220 volt system may require three or four conduits, for example. Many of the applications currently within contemplation, however, require accommodation to a conventional two-wire power source. This disclosure will make primary reference to such applications with the understanding that one of ordinary skill in the art will have no difficulty in adapting the teachings of the disclosure to accommodate to power sources with any number of conductors. In this connection, multi-conductor cables, such as those used for telecommunication systems and low voltage paired wire systems, are specifically within contemplation.

A core mounted internal the post is usually preferred for a variety of practical and aesthetic reasons. Nevertheless, it is feasible to fashion an insulation member to mount on the exterior of the post to provide an external mounting of the conductive elements. In either case, the power conductors are preferably strung inside the post and arm members to transfer current across a swivel or pivot connection between them.

Each conductive element is electrically associated with a contact ring which circumscribes the post in mechanical association with the pivot connection. In some constructions, the contact rings serve as conductive elements, and no separate such structure is required. Corresponding brush contacts extend from conductors carried by an arm which extends from the pivot connection. The brush contacts are mounted to effect conductive friction contacts with the surfaces of respective contact rings. The conductive friction contacts are maintained throughout multiple full 360° rotations of the arm with respect to the post.

The contact rings and corresponding brush assemblies will be configurated to accommodate the requisite number of current and neutral paths appropriate for a specific installation. For a system requiring a single potential lead and a single neutral or return path, the contact rings may conveniently be configurated as flat discs separated by an insulating collar. In that construction, the contact surfaces are oriented in respective planes approximately parallel the arm and approximately transverse the post. Other embodiments provide a stacked array of conductive rings sandwiched between insulating layers. The contact surfaces of those arrays are approximately parallel the post. In any event, the contact brushes associated with the arm are oriented and configurated appropriately to maintain electrical conduction through a conductive friction contact of a biased brush against a contact surface of each contact ring. The contact surfaces of the contact rings are approximately concentric with the post to facilitate maintenance of a current-transferring such contact throughout a full 360° rotation of an arm with respect to a post.

In a broad context, the invention may be regarded as a power delivery structure including a hollow post element, a mechanical pivot assembly associated with the post element, a hollow arm element attached to the post element by means of the pivot assembly so that the arm may be freely traveled an indefinite number of pivot rotations around the post element, any convenient number of conductive rings mounted external to and concentric with the post element (the rings will ordinarily of necessity be mechanically associated with the pivot assembly), a corresponding number of conductive brush elements mounted internal the arm with individual brush elements biased into current-transfer contact with individual contact rings, and appropriate conductors leading from the rings and brush elements, respectively, through the interiors of the post element and arm, respectively. Although a power source may be connected to any of the conductors in the system, most installations feed power to a fixed end of a post and distribute power from that end through a network of arms and additional posts via a plurality of contact ring/brush element interfaces wherever a pivot connection occurs. Current flow may be from a ring to a brush or from a brush to a ring.

BRIEF DESCRIPTION OF THE DRAWINGS

In the drawings, which illustrate what is presently regarded as the best mode for carrying out the invention.

DESCRIPTION OF THE ILLUSTRATED EMBODIMENT

Figure 1:
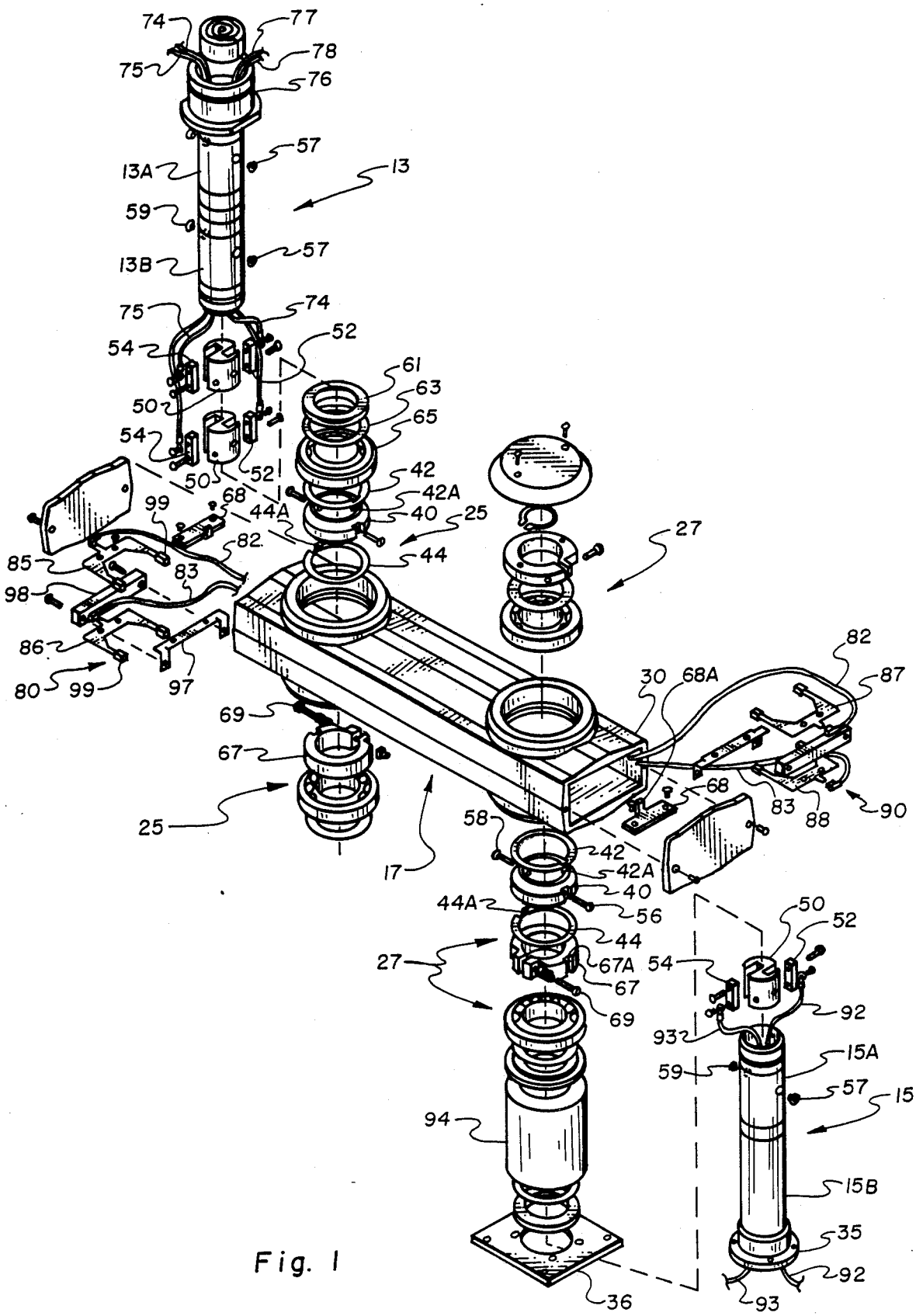
FIG. 1 is an exploded perspective view of an application utilizing an embodiment of the invention.
Figure 2:
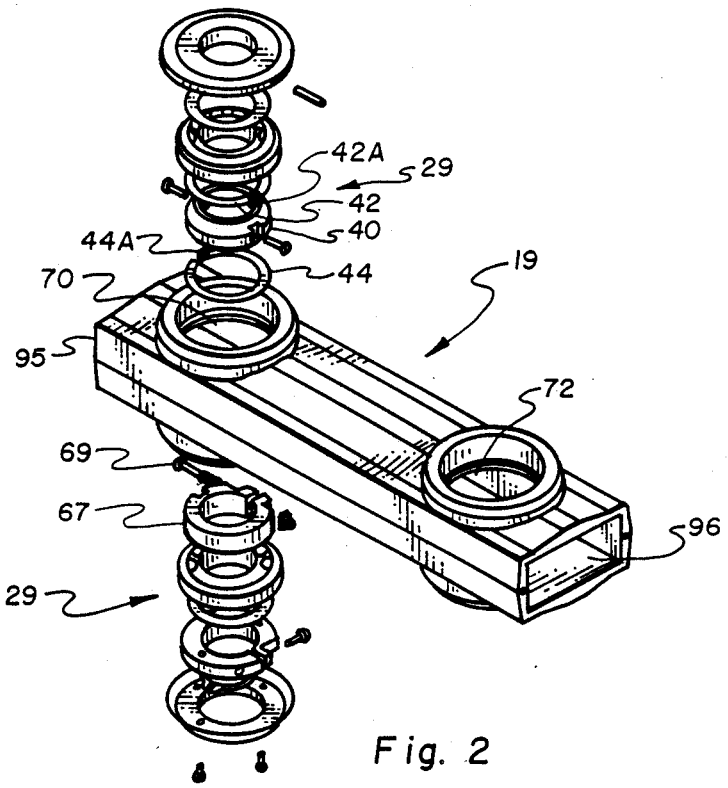
FIG. 2 is an exploded perspective view of additional components for use with the components illustrated by FIG. 1.
Figure 4:
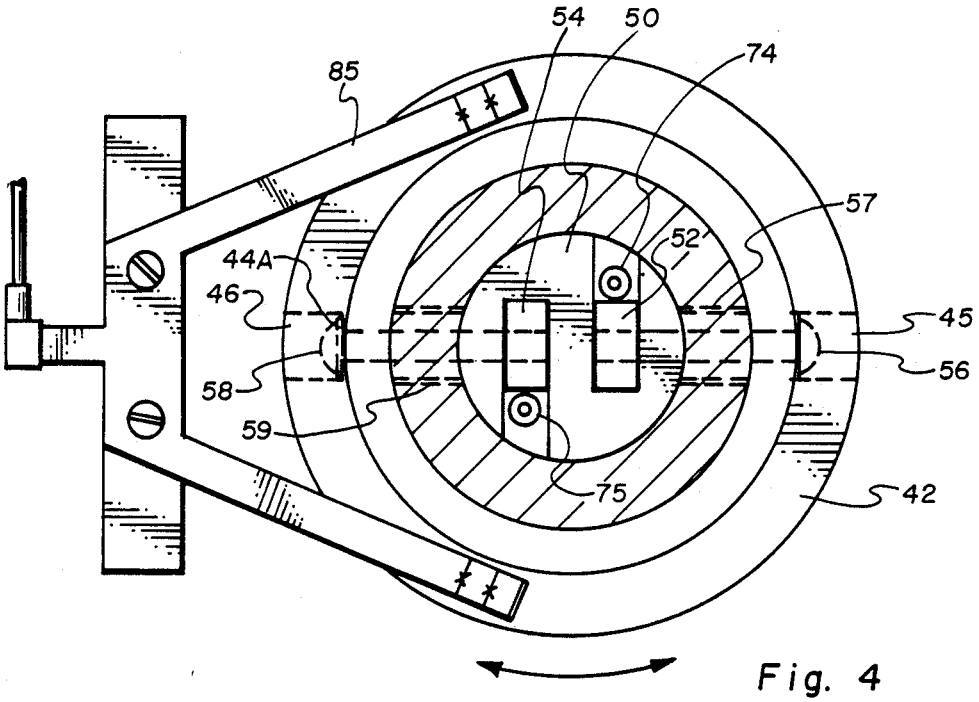
FIG. 4 is a top plan view of the assembly of FIG. 3.

FIGS. 1 and 2 illustrate broadly the manner in which the contact assembly, designated generally 11 (FIG. 3) may be incorporated into a variety of structural arrangements. Hollow posts 13, 15 (FIG. 1), oriented generally vertically, are coupled to arms 17 (FIG. 1), 19 (FIG. 2), shown as generally horizontal beams, through bearing assemblies 25, 27 (FIG. 1) and 29 (FIG. 2) which permit in each instance full 360° rotation of the various posts 13, 15, with respect to the coupled arms 17, 19.

Considering the post 13 to be a fixed member; e.g., rigidly attached to a ceiling or track mounting, the arm 17 is coupled in free (without stops or limits) rotational association with the post 13 by means of the assembly 25. With the arm 17 swung to a selected orientation, its distal end 30 may be regarded as "fixed." The post 15 is free to rotate through multiple 360° travel paths within the coupling assembly 27 with respect to the arm 17. A flange 35 connects to a mounting plate 36 which functions as a structural support for an electric powered device, such as a surgical lighthead (not shown).

Figure 3:
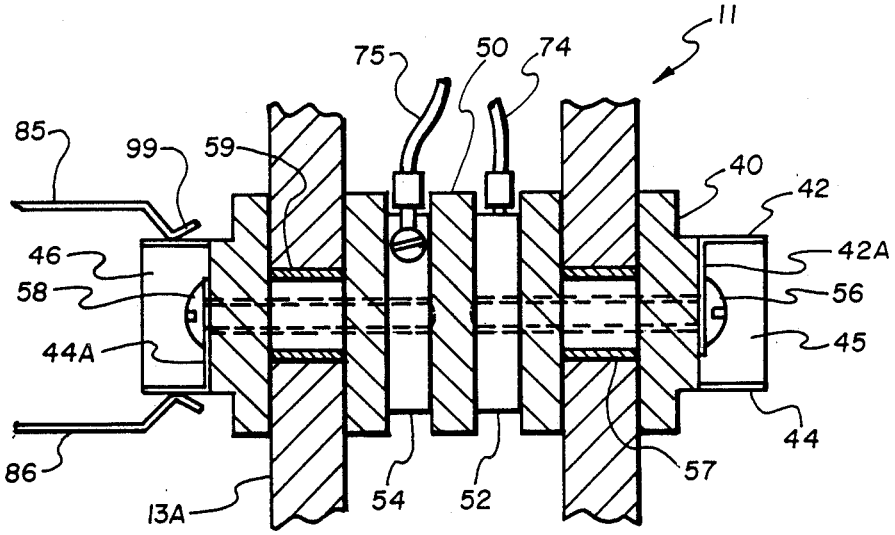
FIG. 3 is a view in section of a contact assembly of this invention.

Each of the coupling assemblies 25, 27, 29 includes a collar 40 of insulating material which is attached to a respective post segment 13A, 15A, 13B. These segments, and thus the collars 14 are located on the interior of the arms 17 (13A, 15A) and 19 (13B) in assembled condition. FIGS. 1 through 4 illustrate an assembly 11 in which the collar 40 carries a pair 42, 44 of contact rings. As best shown by FIG. 3, the ring 42 includes a depending tab 42A and the ring 44 includes a depending tab 44A. The tabs 42A, 44A are received by channels 45, 46 which lock the rings 42, 44 in place.

Each collar 40 constitutes a portion of an electrical transfer assembly 11 which in the instance illustrated by FIGS. 1 through 4 also includes an insulating core element 50. The cores are positioned inside the hollow post segments 13A, 15A, 13B and provide electrical isolation for a pair of conductive bars 52, 54. Contact ring 42 is conductively and structurally connected to the conductive bar 52 by means of a bolt 56 which extends through the tab 42A and an insulated sleeve 57. Contact ring 44 is similarly connected to conductive bar 54 by means of a bolt 58 which extends through the tab 44A and an insulated sleeve 59.

The remaining components of the coupling assemblies 25, 27, 29 are disc springs 61, thrust races 63, radial ball bearings 65, collar braces 67 and associated fasteners present in conventional arrangement to provide a reliable and structurally adequate pivoting connection.

For an arrangement requiring a single arm 17, post segment 13B, its associated internal components and the structures illustrated by FIG. 2 are unnecessary. The second arm 19 may be mounted beneath the arm 17 by means of the coupling assembly 29, however, in which case the segment 13B (FIG. 1) is positioned within the cylindrical channel 70 (FIG. 2). Components similar to the post 15 and the assembly 27 can then be mounted in association with the cylindrical channel 72 to carry a second, independently positionable, electrically powered device.

A first pair of oonductors 74, 75 extends from a power source (not shown) at the mounted end 76 of the post 13. These conductors connect to respective bars 52, 54 mounted within the post segment 13A. A second set of conductors 77, 78 connects with respective bars 54, 54 mounted within the post segment 13B. A first brush assembly, designated generally 80, is mounted to interact with the contact rings 42, 44 carried external the segment 13A. Wires 82, 83 connect the brush contacts 85, 86 of the first brush assembly 80 to corresponding contacts 87, 88 of a second brush assembly, designated generally 90, at the other end 30 of the arm 17. The assembly 90 interacts with the contact rings 42, 44 of the collar 40 associated with post segment 15A. Accordingly, electrical power is transferred via the bars 52, 54 within the segment 15A and associated conductors 92, 93 to a device (not shown) carried by the mounting plate 36. Appropriate spacing of the device from the arm 17 is provided by the relatively long post segment 15B and spacer 94. A third brush assembly (not shown) similar in construction to the assemblies 80, 90 may be mounted at the end 95 of the arm 19 to interact with the contact rings 42, 44 associated with the post segment 13B. A fourth such brush assembly (not shown) may be installed at the opposite end 96 of the arm 19 to transfer power to a second device carried as previously described by structure similar to the assembly 27.

Each brush assembly, e.g. 80, is mounted to an arm 17, 19 by means of a support bracket 97 and an insulating block 98. The block 98 provides spacing to accommodate the desired amount of spring tension appropriate to maintain a good conductive friction contact between the shaped brush contacts 99 and the contact rings 42, 44.

Figure 5:
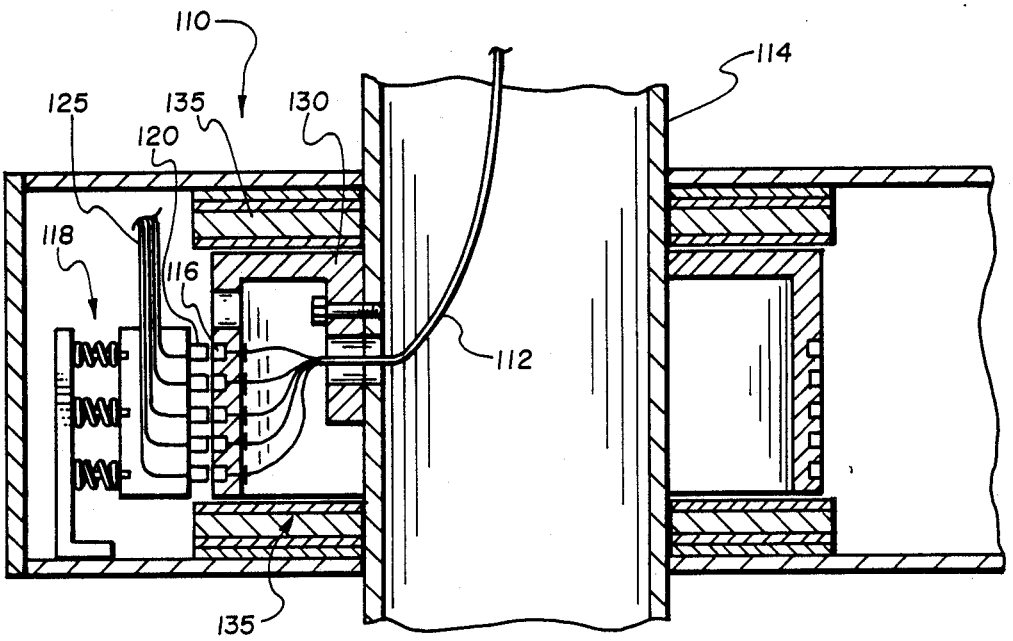
FIG. 5 is a schematic view of a section of an alternative form of the invention.

Other current-transfer assemblies 110 (FIG. 5), are within contemplation in which a large number of conductors 112 extend through a hollow post segment 114 to connect to individual conductor rings 116. A spring-biased brush assembly 118 holds individual brush contacts 120 in electrical contact with the rings 116 for transfer of current via conductors 125. An insulated collar 130 which supports and electrically isolates the individual contact rings 116 is bolted directly to the post 114 between other components 135 of a pivot bearing assembly.

Reference herein to details of the illustrated embodiments is not intended to limit the scope of the claims which themselves recite those features regarded as important to the invention. The drawings omit certain redundant components and illustrate certain other components which, while not specifically referred to in the specification, will be instructive to one of ordinary skill in the art.

I claim:

1. An electrical contact assembly constituting means for transferring electrical current from a source to an electrical device through a rotating mechanical linkage, comprising:

a hollow post;

a mechanical linkage assembly structurally associated with such post, said linkage assembly having first and second elements capable of 360° rotation with respect to each other;

an arm member mounted transversely to said post through said first and second elements;

an insulating core mounted inside said post, said core housing a plurality of contact terminals in electrical isolation from each other;

an insulating collar concentric to said insulating core mounted external said post;

a plurality of conductive contact rings concentric to said post, each said contact ring being electrically and mechanically connected to said contact terminal through said collar;

an electrical brush assembly carried by said arm;

a plurality of conductive brush elements, extending from said brush assembly, each said brush element being in electrically conductive association with a said conductive ring through a biased friction surface contact;

a plurality of first conductors extending from electrical connection to respective said plurality of contact terminals through said hollow post, said first conductors constituting means for carrying electrical current from or to a first remote location; and a plurality of second conductors extending from electrical connection to respective of said plurality of brush elements through said arm, said second conductors constituting means for carrying electrical current to or from a second remote location.

2. An electrical contact assembly according to claim 1 wherein said contact rings are shaped as discs and the friction surface contacts between said discs and said brush elements are oriented in planes transverse said hollow post.

3. An electrical contact assembly according to claim 1 wherein said post is fixed and said arm is cantilevered from said post by said mechanical linkage assembly, whereby to permit said arm to rotate completely about said post an indefinite number of rotations.

4. An electrical contact assembly according to claim 1 wherein said contact terminals comprise conductive blocks, said blocks further constituting structural support means for said contact rings.

5. An electrical contact assembly according to claim 1 wherein said collar is mechanically associated with said mechanical linkage.

6. An electrical contact assembly according to claim 5 wherein said contact rings and said brush assembly are mounted within said arm.

7. An electrical contact assembly according to claim 6 wherein said contact rings are shaped as discs and the friction surface contacts between said discs and said brush elements are oriented in planes transverse said hollow post.

8. An electrical contact assembly according to claim 6 wherein said post is fixed and said arm is cantilevered from said post by said mechanical linkage assembly, whereby to permit said arm to rotate completely about said post an indefinite number of rotations.

9. An electrical contact assembly according to claim 6 wherein said contact terminals comprise conductive blocks, said blocks further constituting structural support means for said contact rings.

10. An electrical contact assembly according to claim 9 wherein said contact rings are shaped as discs and the friction surface contacts between said discs and said brush elements are oriented in planes transverse said hollow post.

11. An electrical contact assembly according to claim 10 wherein said post is fixed and said arm is cantilevered from said post by said mechanical linkage assembly, whereby to permit said arm to rotate completely about said post an indefinite number of rotations.

12. Power delivery structure, comprising:

a hollow post element;

a mechanical pivot assembly associated with said post;

a hollow arm element attached to said post element by means of said mechanical pivot assembly whereby said arm may be pivoted around said post an indefinite number of complete 360° rotations;

a plurality of electrically conductive contact rings mounted external to and concentric with said post element and mechanically associated with said pivot assembly, said contact rings being electrically isolated from each other;

a plurality of conductive brush elements mounted internal said arm with individual said brush elements in current-transfer contact with individual said contact rings, said brush elements being electrically isolated from each other;

first conductors extending from electrical connection to respective said contact rings through the interior of said post element; and second conductors extending from electrical connection to respective said brush elements through the interior of said arm.

13. A power delivery structure according to claim 12 wherein said contact rings and said brush elements are mounted within said arm.

14. A power delivery structure according to claim 13 wherein said contact rings are mounted on an insulating collar attached to said post element.

15. A power delivery structure according to claim 14 including an insulating core element mounted internal said post concentric with said collar, said core element housing contact terminals, individual said terminals being electrically connected to individual said contact rings.

16. A power delivery structure according to claim 15 wherein said contact rings are shaped as discs and the friction surface contacts between said discs and said brush elements are oriented in planes transverse said hollow post.

17. A power delivery structure according to claim 16 wherein said contact terminals comprise conductive blocks, said blocks further constituting structural support means for said contact rings.

* * * * *